US006264574B1

(12) United States Patent
Nelson et al.

(10) Patent No.: US 6,264,574 B1
(45) Date of Patent: Jul. 24, 2001

(54) GAME BALL AND METHOD OF USING GAME BALL

(75) Inventors: Webb T. Nelson; Michael E. McGonigle, both of Seattle, WA (US)

(73) Assignee: Play Visions, Inc., Woodinville, WA (US)

( * ) Notice: Subject to any disclaimer, the term of this patent is extended or adjusted under 35 U.S.C. 154(b) by 0 days.

(21) Appl. No.: 09/045,200

(22) Filed: Mar. 20, 1998

(51) Int. Cl.[7] ..... A63B 43/00

(52) U.S. Cl. ..... 473/603; 473/595; 473/613; 273/DIG. 20

(58) Field of Search ..... 473/569, 594, 473/595, 603, 604, 607, 613; 273/DIG. 20

(56) References Cited

U.S. PATENT DOCUMENTS

| | | | | |
|---|---|---|---|---|
| 1,513,773 | | 11/1924 | Thompson . | |
| 2,524,546 | | 10/1950 | Sinclaire . | |
| 4,128,238 | * | 12/1978 | Newcomb et al. | 273/DIG. 20 |
| 4,599,077 | | 7/1986 | Vuillard . | |
| 4,736,948 | * | 4/1988 | Thomas | 473/613 |
| 4,998,728 | | 3/1991 | Traub . | |
| 5,066,018 | | 11/1991 | Hinton . | |
| 5,230,650 | | 7/1993 | Brayton . | |
| 5,398,928 | * | 3/1995 | Rudell et al. | 473/575 |
| 5,458,329 | * | 10/1995 | Bushman et al. | 473/613 |
| 5,460,368 | * | 10/1995 | Pearson | 473/613 |
| 5,566,948 | | 10/1996 | Kidd . | |
| 5,720,644 | | 2/1998 | Ku . | |
| 5,759,109 | | 6/1998 | Martini . | |

FOREIGN PATENT DOCUMENTS

499656 * 1/1939 (GB) ..... 273/DIG. 20

OTHER PUBLICATIONS

Letters from George Dunsay dated Jan. 5, 1984.
"Foobsball" sketch; Jan. 5, 1984.
"Foobsball " image; Jan. 5, 1984.
"Foobsball" (enlarged); Jan. 5, 1984.

* cited by examiner

*Primary Examiner*—Steven Wong
(74) *Attorney, Agent, or Firm*—Marshall, O'Toole, Gerstein, Murray & Borun

(57) ABSTRACT

A game ball is provided for primarily practicing throwing a football in a passing spiral motion to impact a vertical wall, and then via a reactive force, the game ball returns in a passing opposite spiral motion to be caught by the person, who is practicing throwing a football. The body of the game ball has an external appearance looking somewhat like a football, except having only one conical pointed end, referred to as the trailing end, and having the other end, referred to as the leading end, being a substantially planar wall contacting surface. The body is made to absorb a substantial portion of the wall impact energy, and to quickly release a substantial amount of this absorbed energy, which is then directed in the opposite direction, successfully causing the body, serving as the game ball, to return in a passing opposite spiral motion to the locale, where the game ball was initially thrown by a person in a passing spiral motion.

18 Claims, 9 Drawing Sheets

FIG. 4
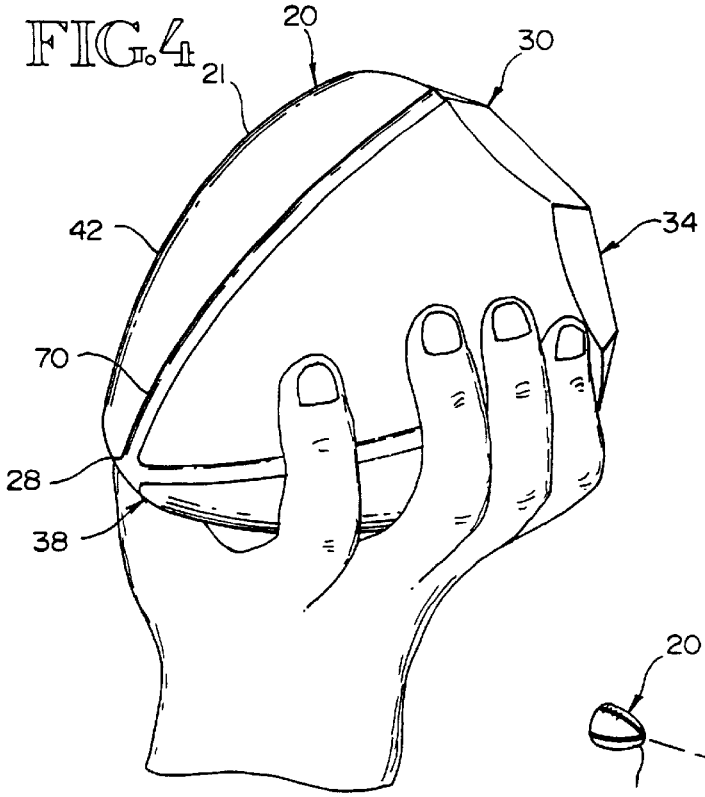
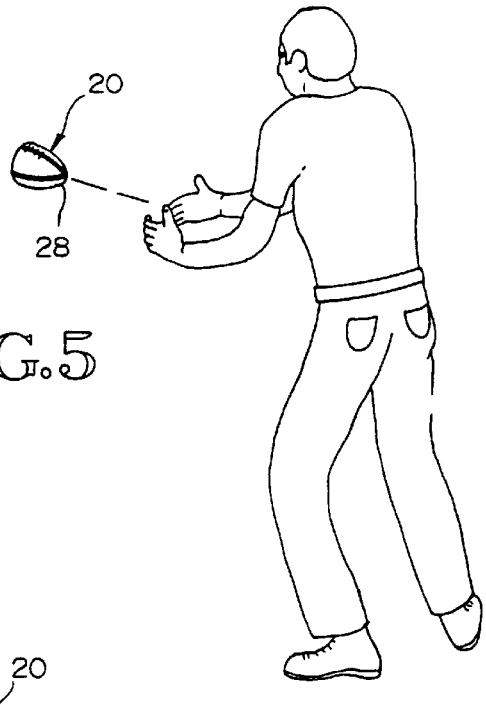
FIG. 5
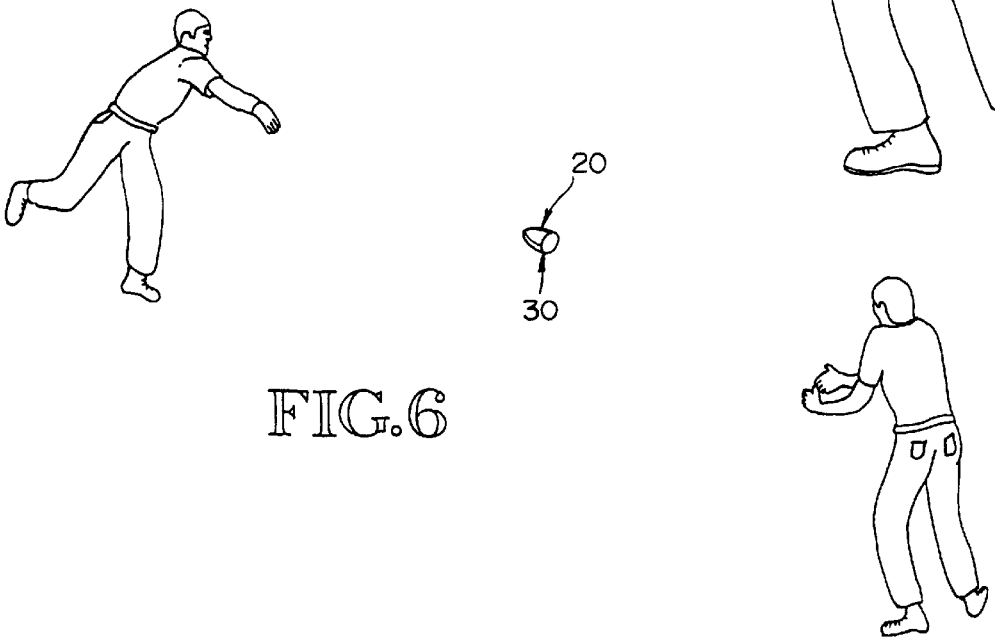
FIG. 6

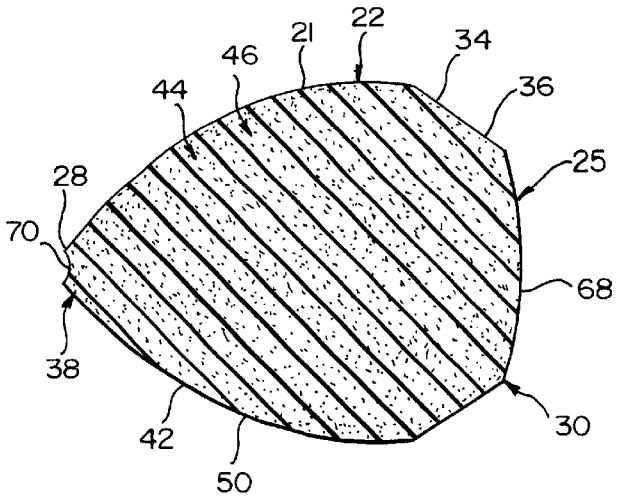
FIG. 13
FIG. 14
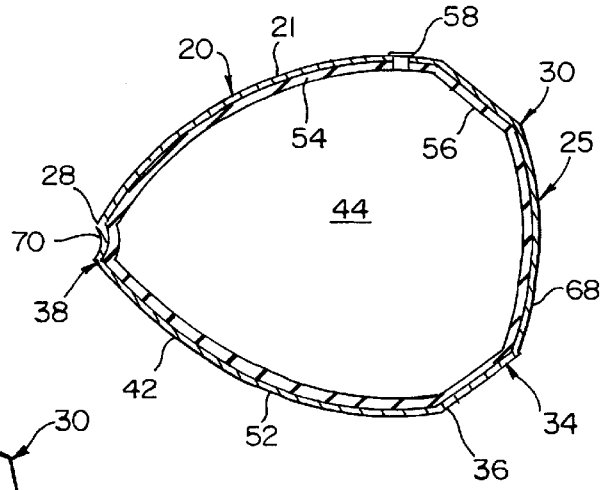
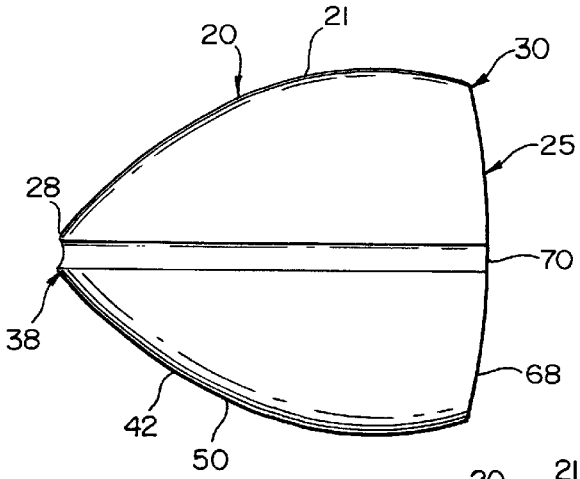
FIG. 15
FIG. 16
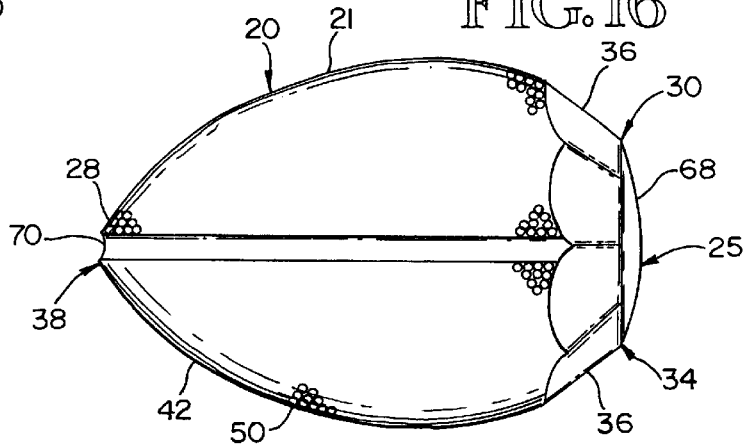

GAME BALL AND METHOD OF USING GAME BALL

BACKGROUND

No game ball was known to be available to a person, who, by himself or herself, could practice spiral passing and catching a football, when a play area having a vertical wall was available, against which the game ball could be impacted for subsequent opposite spiral passing return to this person practicing by himself or herself.

SUMMARY

There are times when a sportsperson wants to practice throwing a football in a way, called passing a football, which in flight is spiralling, resulting in the most accurate, higher speed, and often longest distance the football will travel to the intended target locale. Preferably the sportsperson will have the good fortune of having another sportsperson join with him or her during the practice session. However, many times there is no other person available; therefore this game ball is especially provided to be used by a person in a play area having a wall structure, such as a backstop.

The body of this game ball has an external appearance looking somewhat like a football, except having only one conical pointed end, called the trailing end, and having the other end, called the leading end, being a substantial, planar wall contacting surface. The body is made to absorb a substantial portion of the wall impact energy, and to quickly release a substantial amount of this absorbed energy, which is then directed in the opposite direction, successfully causing the body, serving as the game ball, to return in a passing opposite spiral motion to the locale, where the game ball was intentionally thrown by a person in a passing spiral motion.

The body of this game ball is preferably completely made of a plastic material which, when the game ball hits the wall, compresses and distorts, and then spring like quickly returns to a starting configuration thereof, upon reactively leaving the vertical wall, to return to the locale to be caught, or beyond, where the game ball was initially thrown in a passing spiral motion toward the vertical wall by the person practicing his or her ability to pass a football, and also to catch a football.

The body of this game ball also is made very similar to an inflatable football, having an outer cover, an internal air sealing structure, and an air valve.

Although most of the time a single player will be using the game ball in conjunction with a vertical wall, two or more players will also be using the game ball in conjunction with a vertical wall. The player passing the game ball directs the game ball, so the direction to the wall is at a limited angle, and thereafter the returning game ball follows a resulting limited angle, to reach another player, who did not initially pass the game ball toward the wall at the limited angle of deviation from a perpendicular angle.

Although the game ball does not have each of its ends pointed, the game ball is still used in practice sessions, when a vertical wall is not being used. The game ball may be used to pass among two or more players. Also, the game ball is placed on the conical end and place kicked from a kicking tee, or like support, or while it is spinning like a top on a supporting surface. Also the game ball may be place kicked when its planar surface is in contact with a supporting surface such as a lawn. Also the game ball is readily punted.

DRAWINGS

The game ball for practicing and playing a game like football, and which is capable of returning to a player after impacting a wall, is illustrated in the drawings, in respect to both how it is used, and how it is made, wherein:

FIG. 1 is a perspective view illustrating how a person, using the game ball in a play area having a wall structure, such as a backstop, throws the game ball in a passing spiral motion toward the wall, so the leading end of the game ball having a substantially planar wall contacting surface, contacts the wall in a flight path direction, preferably perpendicular to the plane of the wall, and then the game ball, utilizing a substantial portion of the impact energy, returns in an opposite passing spiral motion with the conical pointed end of the game ball, then being the leading end thereof, to be caught by the person;

FIG. 2 is a perspective view similar to FIG. 1, illustrating how two persons in a play area having a wall, play together using the same game ball, and when one person selects the other person to receive the returning game ball, he or she initially directs the passing spiral motion of the game ball on a flight path direction, which is preferably at a small angle deviation from being otherwise perpendicular to the plane of a wall, whereby the returning game ball, in an opposite spiral passing motion, is directed toward the other person for her or his successful catching of the game ball;

FIG. 4 is a perspective view showing how a player grips the game ball for directing the flight of the game ball in a passing spiral motion;

FIG. 5 is a perspective view showing how a player commences his or her try to conveniently and surely receive and grip the game ball at the conclusion of the flight path thereof, when the game ball is returning from impacting a vertical wall;

FIG. 6 is a perspective view showing how a player tries to conveniently and surely receive and grip the game ball at the conclusion of the flight path thereof, when the game ball has been thrown by one player, for some distance, to be directly caught by another player;

FIG. 13 is a longitudinal cross sectional view of a game ball, which has a full interior of a resilient deflectable material, having a memory which quickly reacts, to release absorbed impact energy to direct the game ball on a return flight path after impacting a wall;

Figure 10:
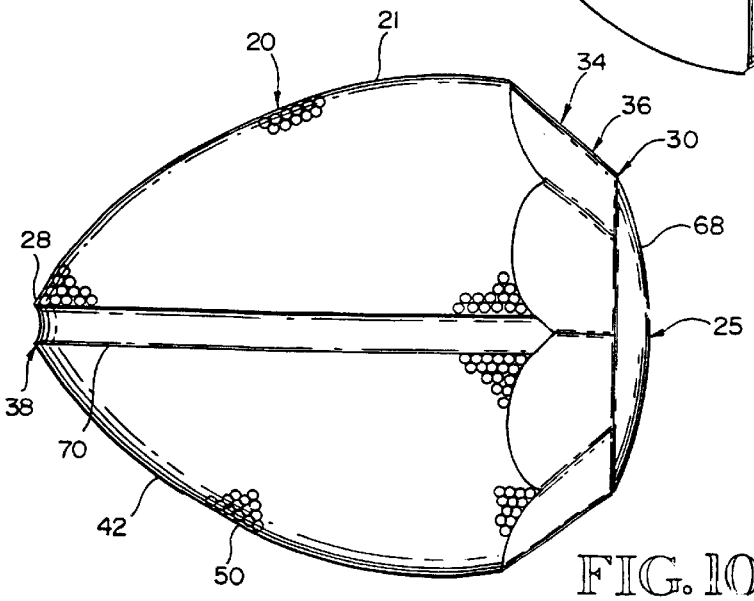
FIG. 10 is a longitudinal side view of the game ball.
Figure 17:
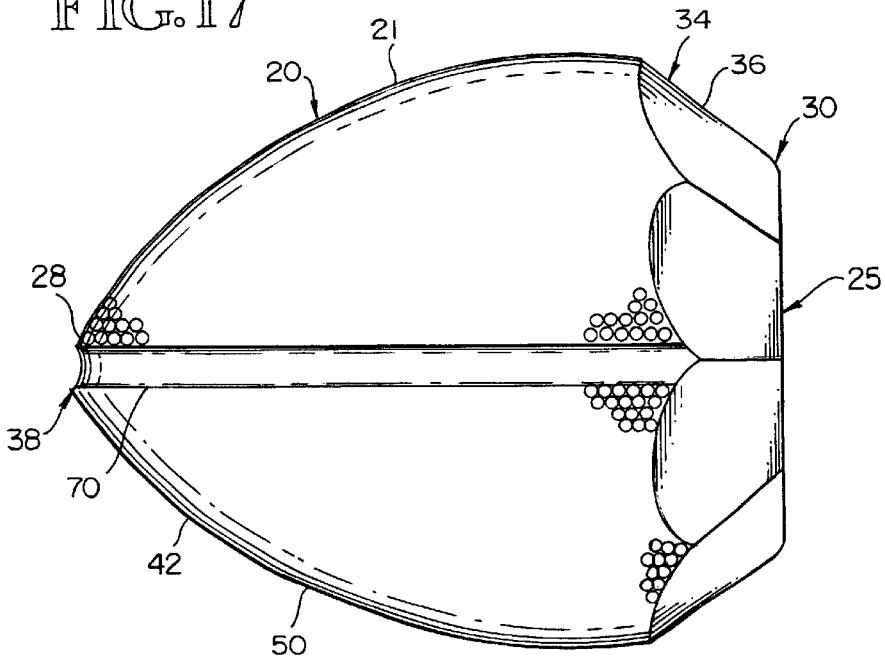
Figure 18:
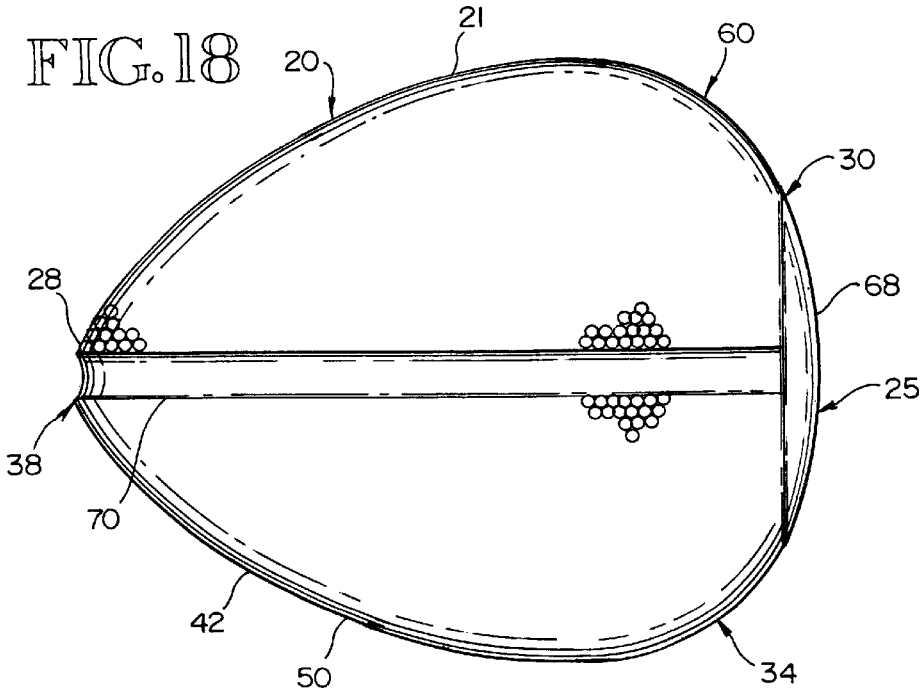
Figure 19:
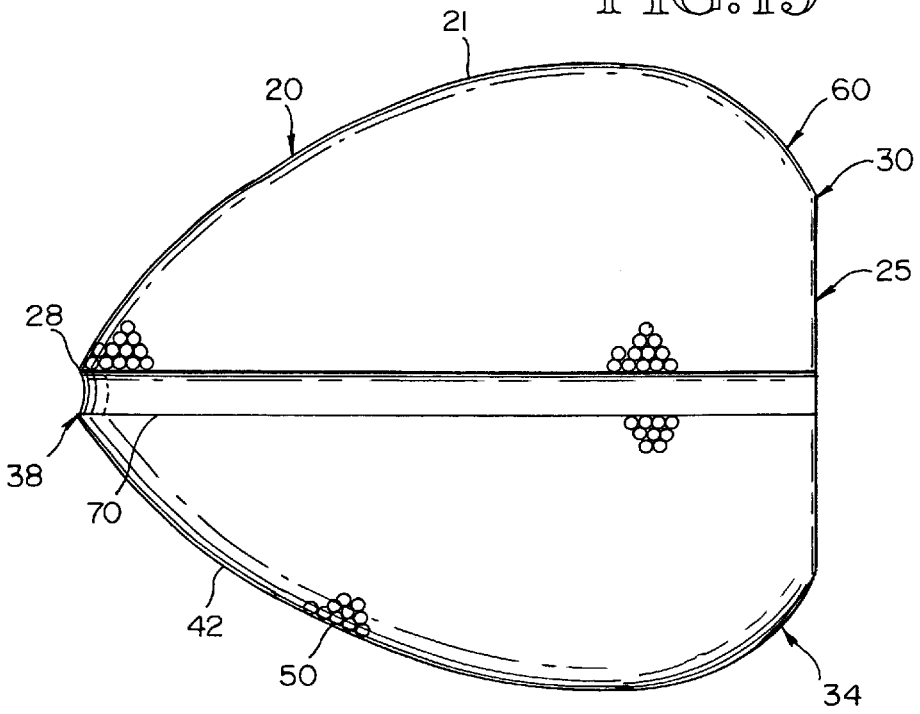
Figure 20:
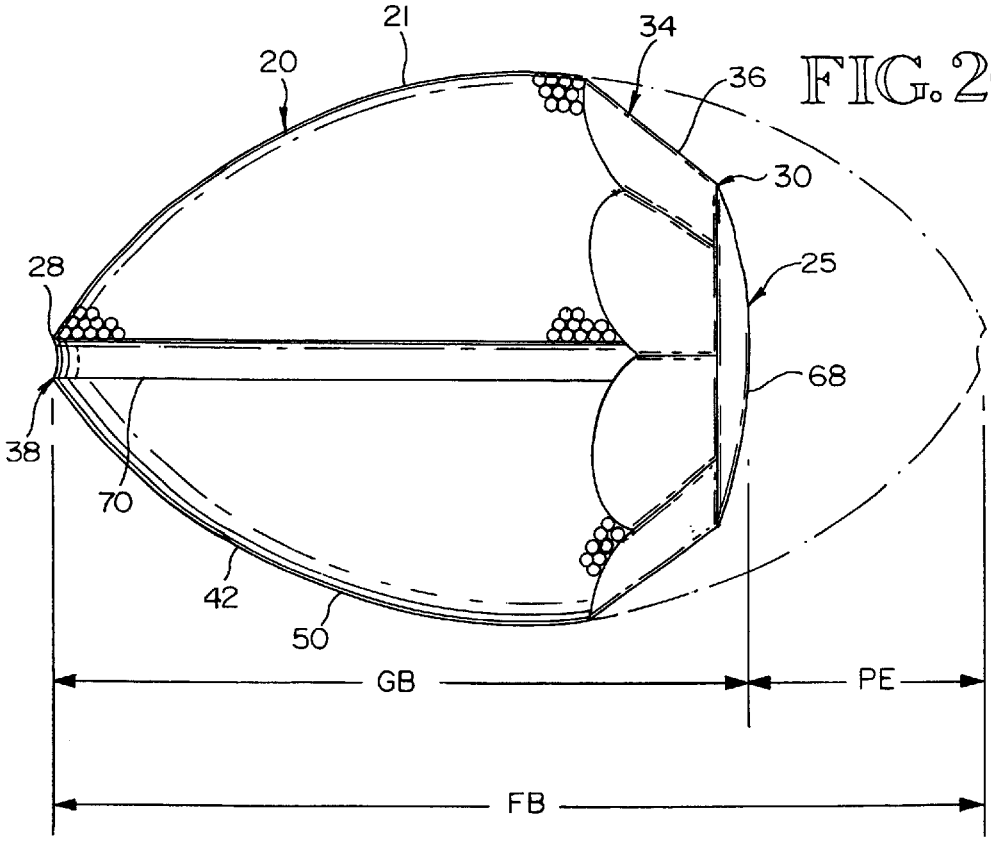
Figure 21:
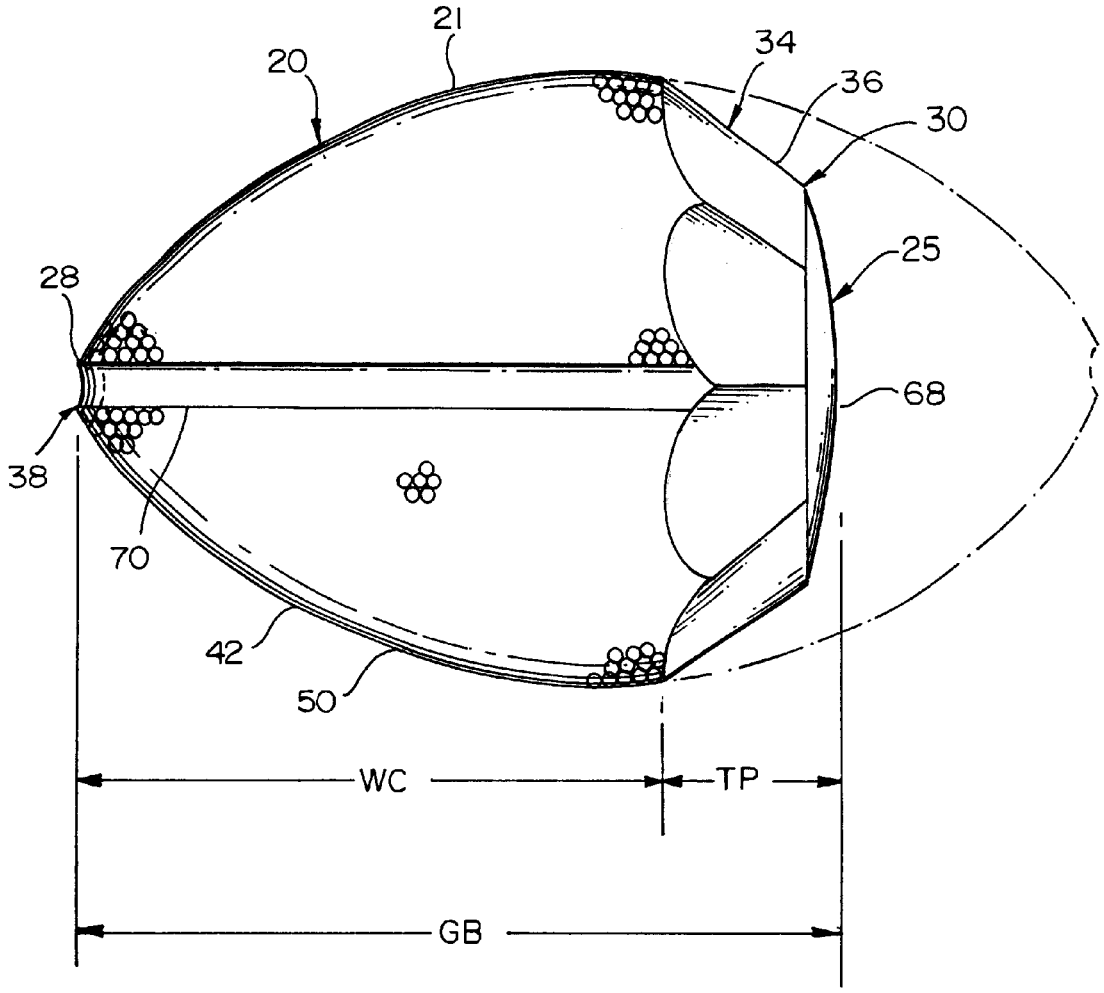

FIG. 14 is a longitudinal cross sectional view of a game ball, which has an outer shell of pliable material, and the inside of the outer shell is made airtight, or a bladder is placed in the interior, and an air valve is secured to the outer shell, and connected to the interior air chamber, and utilized to inflate the game ball; and FIG. 15 is a longitudinal side view of a game ball which does not have a transition portion of selected multiple sided trapezoidal contour adjacent the planar wall contacting surface;

FIG. 16 is a longitudinal side view of a game ball, which in comparison to the game ball shown in FIG. 10, is comparatively longer, being three quarters in length of how long it would have been if it was pointed at both ends like a conventional football;

FIG. 17 is a longitudinal side view of the game ball, which is very similar to the game ball shown in FIG. 10; however, the substantially planar contacting surface is completely planar, with no convex surface portions;

FIG. 18 is a longitudinal side view of the game ball, which is very similar to the game ball shown in FIG. 10; however, there are no eight tapered surfaces in the multiple side trapezoidal contour transition portion, which instead is formed throughout having the same arc when viewed at any cross section, and the substantially planar contacting surface has slightly convex surface portions;

FIG. 19 is a longitudinal side view of the game ball, which is very similar to the game ball shown in FIG. 18; however, the substantially planar contacting surface is completely planar, with no convex surface portions;

FIG. 20 is a longitudinal side view of the game ball, which is like the game ball shown in FIG. 10, and dimension lines are shown with the letters inserted, with the full meanings of, FB for football, GB for game ball, and PE for phantom end, shown in phantom lines; and FIG. 21 is a longitudinal side view of the game ball, which is like the game ball shown in FIG. 10, and dimension lines are shown with the letters inserted, with the full meanings of, GB for game ball, TP for transition portion, and WC for without change, i.e. portions like a conventional football, and phantom lines further indicate the contour of a conventional football.

DESCRIPTION OF THE PREFERRED EMBODIMENTS

How a Person or Persons play with the Game Ball

Figure 1:
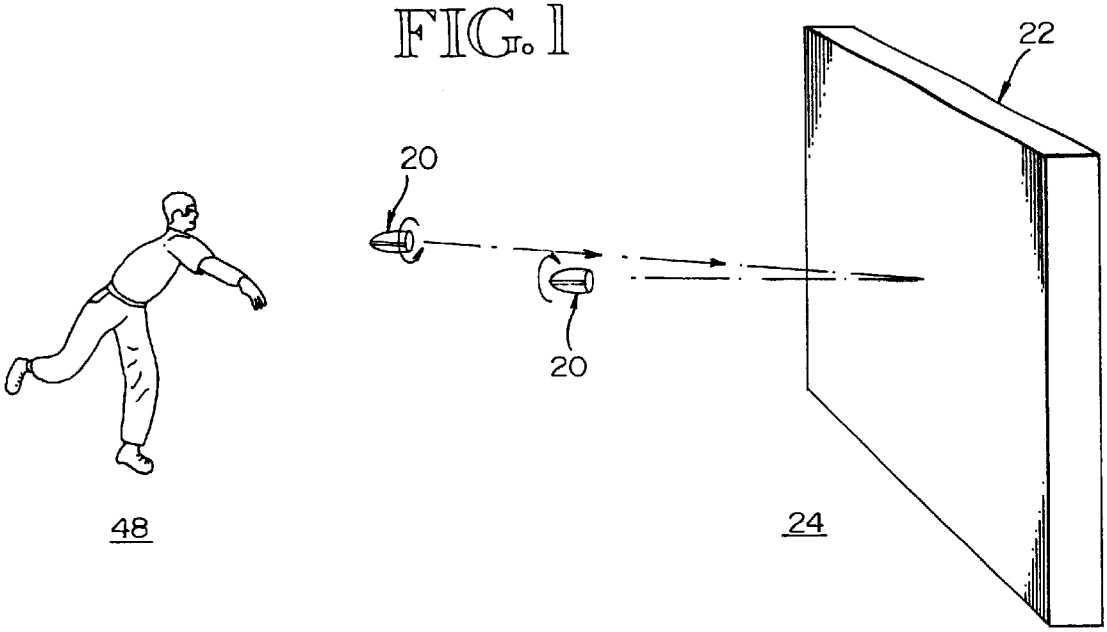
Figure 2:
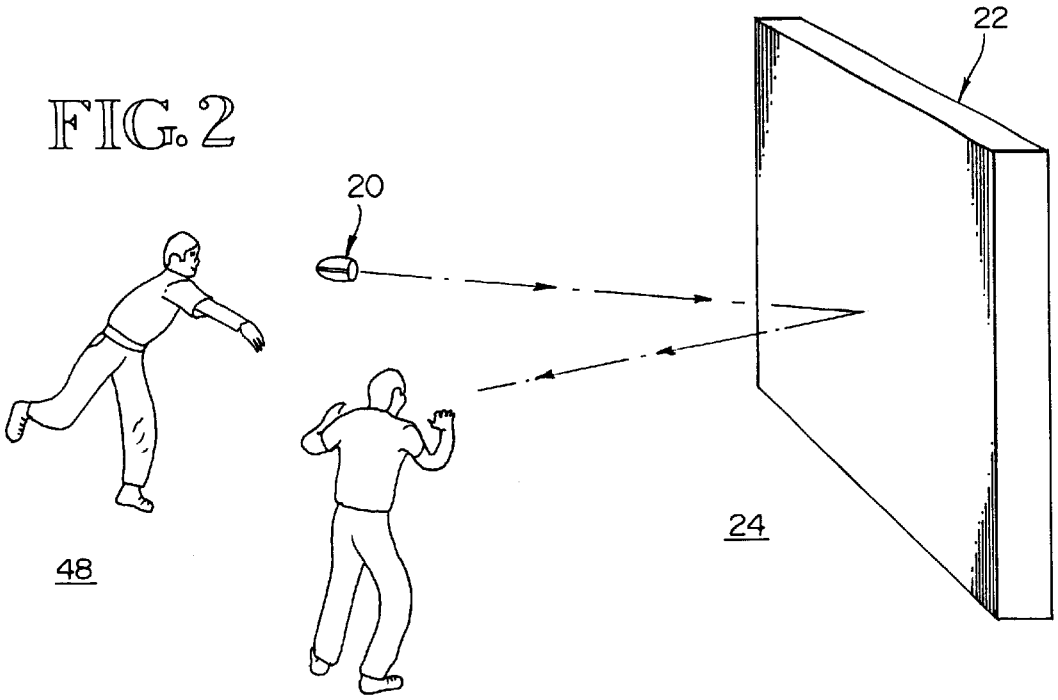

The game ball 20 is particularly useful for one person, as illustrated in FIG. 1, who is practicing throwing a football in a passing spiral motion against a vertical wall 22 or a backstop 22 in a play area 24, with the game ball 20, via a reactive force, returning directly in a passing opposite spiral motion to the person. Also, as illustrated in FIG. 2, in this play area 24, if another person arrives to join in the practice, then when one person selects the other person to receive the returning game ball 20, he or she initially directs the passing spiral motion of the game ball 20 on a flight path direction, which is preferably at a small angle deviation from being otherwise perpendicular to the plane of a wall 22. In this way the game ball 20, instead of returning directly to the thrower, returns in an angular direction, in an opposite spiral passing motion, to reach the other person for her or his successful catching of the game ball 20. On selected occasions, the single player may elect to throw the pass of the game ball 20 at an angle toward the wall, and run a few steps to catch the game ball 20 which is returning at the reactive opposite angular direction.

How the Game Ball Approaches, Contacts, and Departs from a Wall or Backstop

Figure 3:
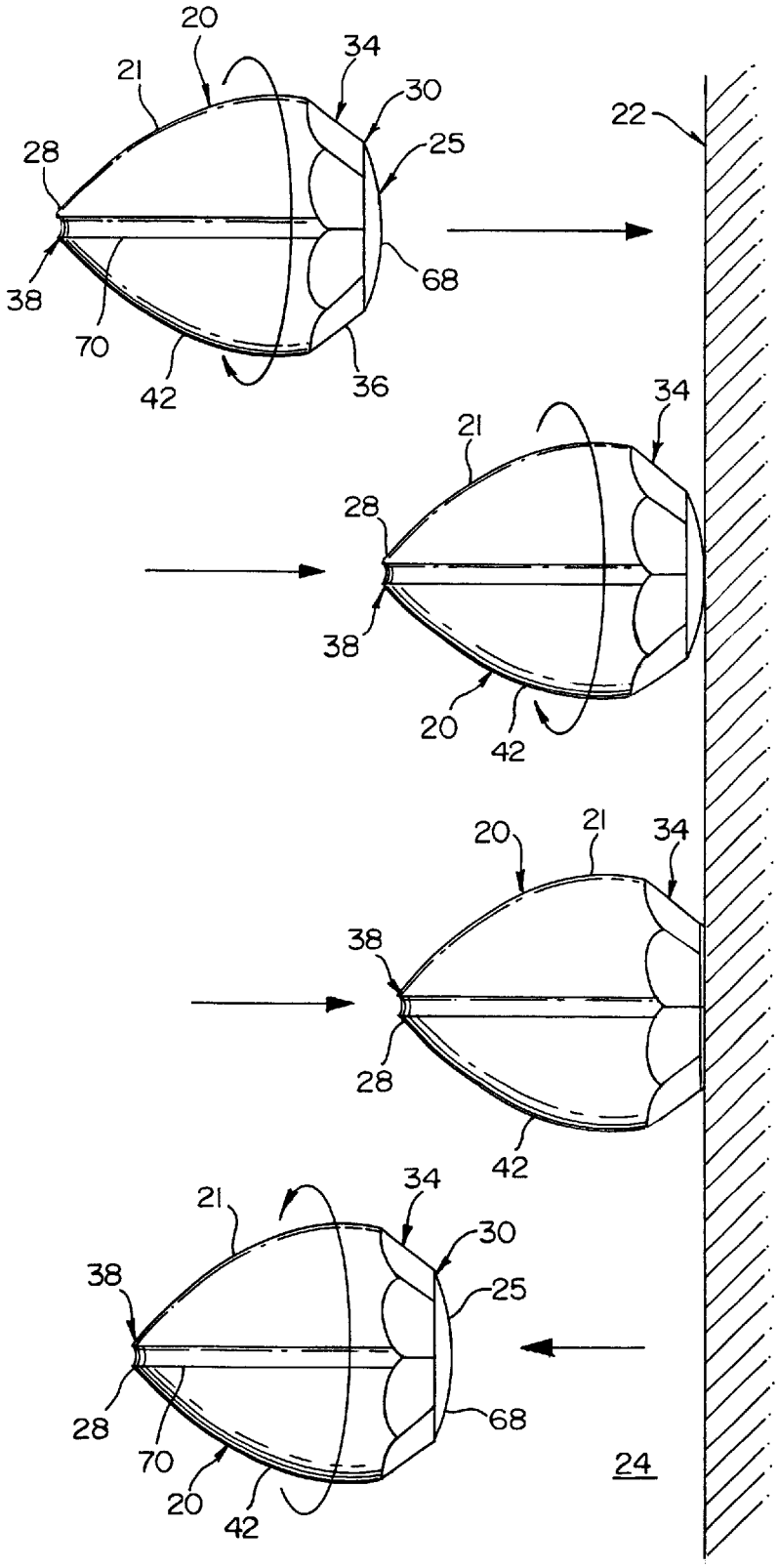
FIG. 3 is a partial side elevation cross sectional view of a vertical wall serving as a backboard illustrating the game ball: approaching the backboard while in a spiral motion; making an initial contact with the backboard; fully contacting the backboard and the spiral motion momentarily stops; and leaving the backboard, while in an opposite rotation spiral motion.

When a person or persons are utilizing a wall 22 or backstop 22 in playing with the game ball 20, how the game ball 20 approaches, contacts, and departs from the wall 22 or backstop 22 is illustrated in FIG. 3. When a right handed person throws the game ball 20, it approaches the wall 22 in the clockwise spiral forward motion and is so spiraling upon the initial contact with the wall. Then the planar wall contacting portions 25 of the game ball 20 deflect and compress, and the game ball 20 absorbs compacting energy, and the spiraling momentarily stops. Very quickly the reactive forces become effective, and the compacting energy is released, and the game ball 20 quickly is on its return flight, while spiraling in the opposite counter clockwise rotational direction.

How a Person or Persons Handle the Game Ball, and Also How the Game Ball is Used Like a Conventional Football Although the game ball 20 is designed and made to be particularly useful in a play area 24 having a vertical wall 22, sometimes being a backstop 22 erected to serve as the vertical wall 22, at other times, wherever the game ball 20 is utilized, other football handling practice is conveniently undertaken. The player grips the game ball 20 in a like way to gripping a football, as shown in FIG. 4. In respect to catching the game ball 20, a player, as shown in FIG. 5, is able to catch the game ball 20 at the conclusion of the flight path thereof, when the game ball 20, with its pointed end 28 leading, is returning after impacting a vertical wall 22. Then as shown in FIG. 6, when the game ball 20 has been thrown by one player, for some distance with the leading end being the planar wall contacting surface 25, to be directly caught by another player, he or she is able to conveniently grip the game ball 20, when the game ball 20 is caught.

Figure 7:
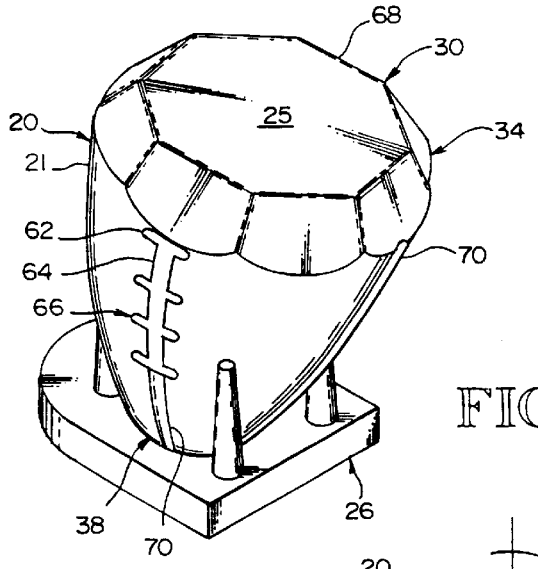
FIG. 7 is a perspective view showing how the game ball is placed on a football kicking tee, or like purpose support.
Figure 8:
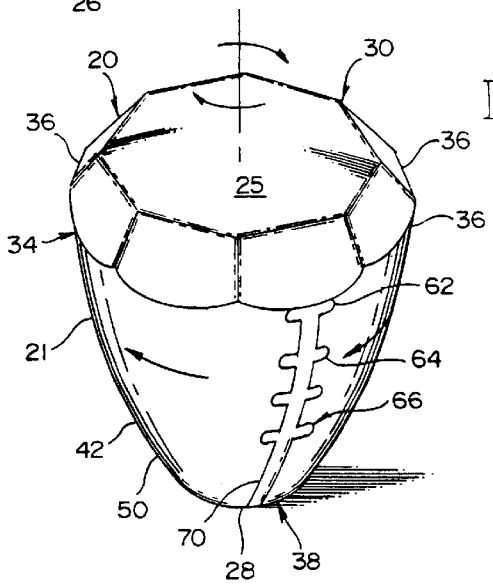
FIG. 8 is a perspective view showing how the game ball is spun like a top, using the pointed end thereof, so while the spinning like a top is underway, a player is able to place kick the game ball.
Figure 9:
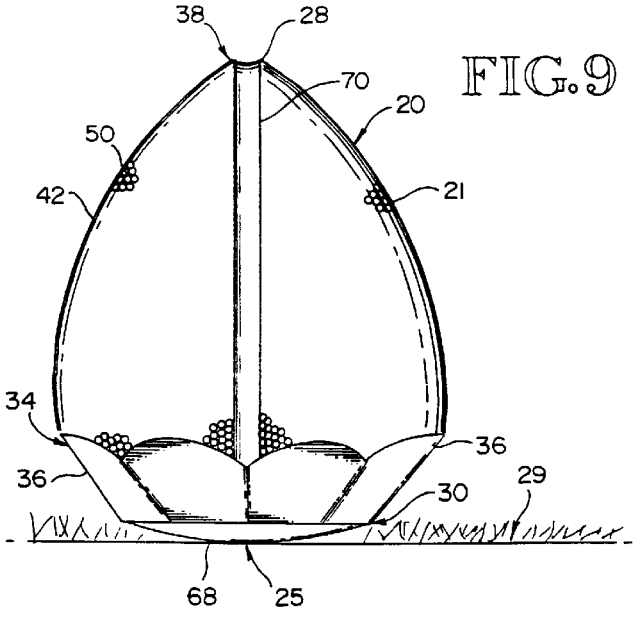
FIG. 9 is an elevational view showing how the game ball is placed on a lawn, for example, with its planar contacting surface, resting on the grass, and a player may place kick the game ball from this supported position.

Also the game ball 20 may be place kicked off a kicking tee 26, or similar purpose support 26, as illustrated in FIG. 7. Also the game ball 20 may be spun like a top, using the pointed end 28 thereof, so while the spinning like a top is underway, a player is able to place kick the game ball 20, as shown in FIG. 8. By way of example, a player may initiate the spinning of the game ball 20, about its longitudinal axis, by using two hands, one hand moving forward away from the person's body, and the other hand simultaneously moving backward toward the person's body. A player also may position the game ball 20 on the grass 29, or other surface, with the planar wall contacting surface 25 resting on the grass 29, for example, as shown in FIG. 9, and from this position the game ball 20 may be place kicked.

How the Game Ball is Shaped and Sized

Figure 11:
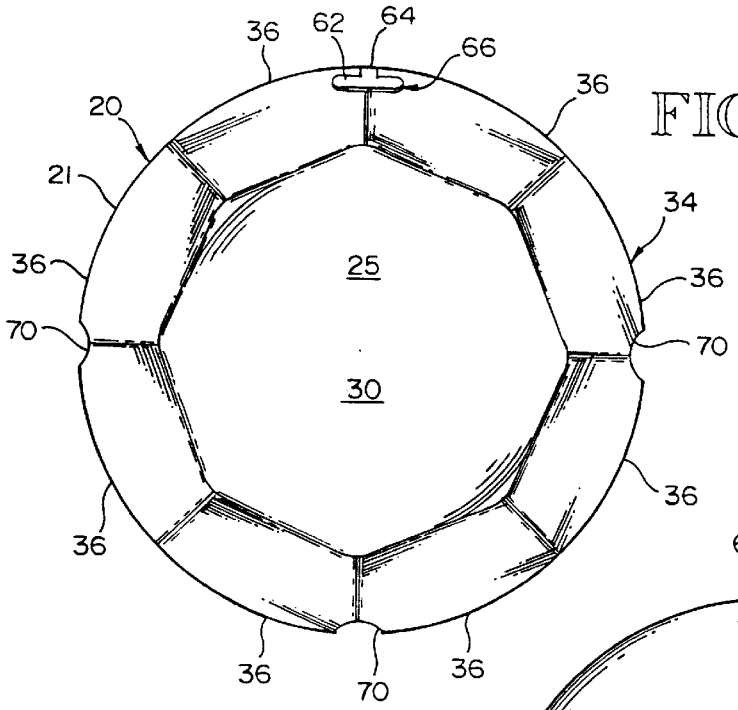
FIG. 11 is a leading end view illustrating both the substantially planar wall contacting surface, and the transition portion of selected multiple sided trapezoidal contour of the game ball.
Figure 12:
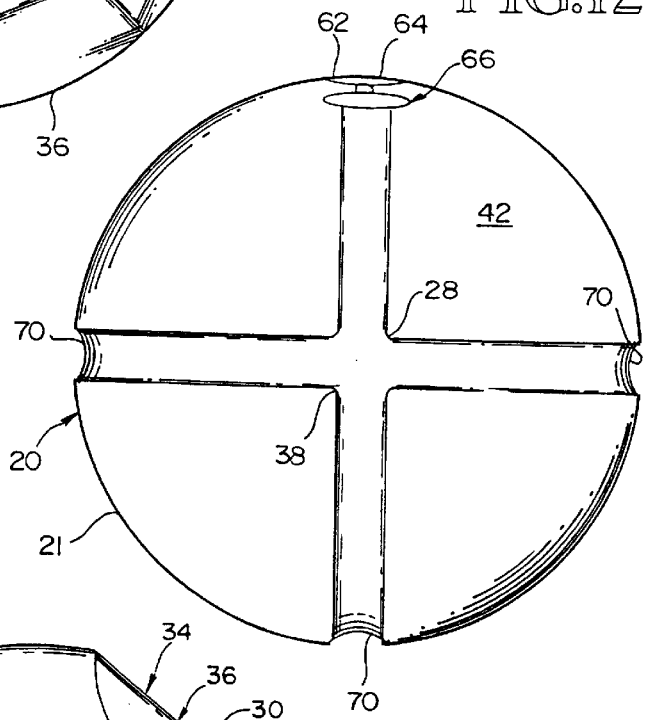
FIG. 12 is the trailing end view illustrating the pointed end and the continuing contour which appears like a regular contoured football.

The preferable shape of the game ball 20 to be so utilized by one player by himself or herself in conjunction with a vertical wall 22 in a play area 24, is illustrated in FIGS. 10, 11, and 12, with: FIG. 10 being a longitudinal side view; FIG. 11 being a leading end view 30 to illustrate both the substantial planar wall contacting surface 25, and the transition portion 34 of a selected multiple sided trapezoidal contour 36 of the game ball 20; and FIG. 12 being a view of the trailing end 38, to illustrate the pointed end 28, and the continuing contour 42, which appears like a regular contoured football.

The overall sizes of the respective bodies 21 of respective game balls 20 will be in a range from larger sizes equaling in their general size to conventional and/or professional footballs used by adults, and to selective smaller general sizes for other younger children of different ages and/or heights. In respect to all sizes of the game balls 20, the leading ends 30 of all the respective bodies 21, in providing the substantially planar wall contacting surface 25, in effect, eliminates an otherwise conical pointed end, which would have extended the overall length of the game ball in the preferable range of 25% to 45%. This range could be from 12% to 55%.

As shown in FIG. 20, three respective lengths are indicated by capital letters. The letters FB, indicate the length of a complete football. The letters GB, indicate the length of the game ball. The letters PE, indicate the phantom end of a complete football, which is shown in phantom lines. In respect to the preferable range of 25% to 45% which pertains to the phantom end PE, if the PE is 25%, then the GB is 75%, with FB always being 100%. If the PE is 45%, then the GB is 55%.

In respect to the preferred utilization near the leading end 30 of each body 21 of each game ball 20, of a transition portion 34, preferably having a selected multiple sided trapezoidal contour 36, the length of this transition portion 34, in respect to the overall length of the game ball 20 is in the preferable range of 1% to 30%. As shown is FIG. 21, three respective lengths are indicated by capital letters. The letters GB, indicate the length of the game ball 20. The letters TP, indicate the length of the transition portion. The letters WC, indicate the length of the game ball 20, without change, which resembles the otherwise conventional contour portion of a football. The phantom lines indicate the football phantom portions which never become portions of a game ball 20.

From the transition portion 34 to the trailing end 38 of each body 21 of each game ball 20, the overall appearance and proportional sizes and changing cross sectional diameters are all representative of conventional appearing footballs of their respective sizes for adults and children.

Although the direct formation of a planar wall contacting surface 25 on any body 21 of a game ball 20 at the leading end 30 will result in a reasonably satisfactory performing game ball 20, the utilization of a transition portion 34 is considered to be more beneficial in gaining a better performing game ball 20. The body 21, when so formed, more readily distorts and compresses when the planar wall contacting surface 25 of the game ball 20 impacts the vertical wall 22. The transition portion 34, with the selected multiple sided trapezoidal contour 36 continues the distortion and compression more readily.

Then after the impacting is completed, the collective and temporary stored impact energy is more quickly and effectively released to make sure the game ball 20 will quickly return to the locale 48, where the game ball 20 was thrown. In so doing the arriving passing spiral motion is quickly converted to a departing passing opposite spiral motion of the game ball 20, at this locale of the vertical wall 22.

When the preferred configuration of the game balls 20 is undertaken, then the performance realized is much closer to reaching the ideal referred to as, for every action there is an equal and opposite reaction, for there is less of the loss of energy, which remains captive in the game ball in the short time following the impacting time of the planar wall contacting surface 25 of the body 21 of the game ball 20, with the vertical wall 22, or backstop 22.

As shown in FIGS. 17, 18, and 19, the transition portion 34 and/or the substantially planar wall contacting surface 25 of the game ball 20 are modified in some embodiments. In FIG. 17, the substantially planar wall contacting surface 25 is all planar without any convex surfaces 68. In FIG. 18 there are no eight tapered surfaces 40 in the multiple side trapezoidal contour 36 transition portion 34. Instead the transition portion 34 is formed throughout having the same arc 60 when viewed at any cross section. The substantially planar contacting surface 25 does have slightly convex surface portions 68. In FIG. 19 there are no eight tapered surfaces 40 in the multiple side trapezoidal contour transition portion 36. Instead it is formed throughout having the same arc 60 when viewed at any cross section. The substantially planar contacting surface 25 does not have any slightly convex surface portions 68.

How the Game Ball is Made

The preferable making of selective game balls 20 is illustrated in two selected embodiments. In FIG. 13 a longitudinal cross sectional view of a game ball 20 is illustrated, wherein the full interior 44 is occupied by a resilient deflectable material 46, having a memory which quickly reacts, after this material is distorted upon striking and impacting the vertical wall 22, to release the absorbed impact energy, as the material returns to the original shape, and thereby to direct the game ball 20 on a return flight path to reach the locale 48, where the game ball 20 was initially passed in a spiral motion directed toward the vertical wall 22. The outer shell like structure 50 of this embodiment or type of game ball 20 is preferably made of the same resilient deflectable material 46. During the molding process this outer shell like structure 50 becomes more dense, while retaining excellent deflecting and memory returning properties, similar to those same properties provided by having the fully occupying resilient deflectable material 46 throughout the interior 44 of the game ball 20.

In FIG. 14 another longitudinal cross sectional view of a game ball 20 is illustrated, wherein a deflectable outer shell cover 52 is provided and the interior thereof is made airtight by directly using a sealing material 54 or indirectly by using a bladder material 56. An air valve 58 is positioned in the deflectable outer shell cover 52 to be used during the air inflation of this embodiment of the game ball 20.

Preferably indicia 62, and/or protuberances 64, and/or laces 66, are positioned on the game balls 20 to appear, as they respectively appear on the various available footballs, as illustrated in the respective end views of FIGS. 11 and 12.

In respect to materials utilized in making these game balls 20, they are rubber like materials with memory qualities, so they will return to their original shape. In regard to plastic materials which have these like memory qualities, and which are used in the outer shell structure 50 and in the full interior 44, the following plastics are used: polyurethane, called PU; polyethylene, called PE, and polyvinyl chloride, called PVC. Also both natural and synthetic rubbers are used.

In regard to outer shell covers 52 for air filled game balls 20, the following materials are used: polyurethane and rubber.

In regard to sealing materials, preferably rubber cement is used.

In regard to bladders, preferably rubber is used.

Comparatively lighter weight game balls 20 are made of rubber, which is two mils in thickness. A valve of essentially like material is sealed to these balls, which are often mouth inflated like a small balloon is inflated.

Outer Observable Features

It is noted when observing the planar wall contacting surface 25, it has a slightly convex appearance 68, which preferably results from a selected manufacturing process. In various figures of the drawings, this essentially planar wall contacting surface 25, in contrast to the conventional pointed end of a football, is shown as being: precisely planar; planar with slightly convex appearance; and planar with a more extensive convex appearance, which then includes the transition portion, formed to have the same arc cross section throughout. Also there are preferably four spaced longitudinal grooves 70, which provide finger gripping locations. The game ball 20 in other embodiments has more gripping locations, and also has no finger gripping locations.

The Main Purpose of the Game Ball

The main purpose in selecting the various materials and how they are to be incorporated to manufacture a game ball 20, is to obtain a resulting game ball 20, which is effectively played with by a player, when practicing, to perfect his or her pass throwing and catching abilities in regard to subsequently using a conventional football in a football game. As illustrated in FIG. 1, this game ball 20 must adequately permit his or her practice in a play area 24, where a vertical wall 22 or backstop 22 is available, against which, the game ball 20 in a spiral passing motion is impacted for the successful return flight path, when the game ball 20 is passing in the opposite spiral motion to be caught by the person who is practicing by herself or himself.

We claim:

1. A method of using a game ball having a first end and a second end, said first end of said game ball having a truncated contact surface and said second end of said game ball being pointed, said game ball having a body portion that is rotationally symmetric about an axis passing through a central portion of said truncated contact surface and said second end, said method comprising the steps of:

(a) throwing said game ball towards a rebound surface from a throwing location spaced from said rebound surface by a separation distance so that said truncated contact surface of said game ball leads said pointed end of said game ball as said game ball travels towards said rebound surface;

(b) impacting said game ball against said rebound surface so that said game ball rebounds in a rebound direction away from said rebound surface, with said pointed end leading said game ball during flight of said game ball away from said rebound surface and said truncated contact surface of said game ball following said pointed end during flight of said game ball away from said rebound surface; and (c) catching said game ball at a catching location during flight of said game ball away from said rebound surface, said catching location being spaced from said rebound surface.

2. A method as defined in claim 1 wherein said steps (a) and (c) are performed by the same person.

3. A method as defined in claim 1 wherein said step (a) is performed by a first person and wherein said step (c) is performed by a second person.

4. A method of using a game ball having a first end and a second end, said first end of said game ball having a truncated contact surface and said second end of said game ball being pointed, said game ball having a body portion that is rotationally symmetric about a central axis passing through a central portion of said truncated contact surface and said second end, said method comprising the steps of:

(a) gripping said body portion between said first end of said game ball and said second end of said game ball;

(b) with said game ball being gripped, imparting a forward motion to said game ball in a throwing direction towards a rebound surface while said game ball is oriented so that said truncated contact surface is disposed towards said rebound surface and so that said pointed end is disposed away from said rebound surface;

(c) releasing said game ball in said throwing direction so that said game ball follows a flight path towards said rebound surface, with said truncated contact surface leading said game ball during flight towards said rebound surface and said pointed end of said game ball following said truncated contact surface during flight towards said rebound surface; and (d) impacting said truncated contact surface of said game ball against said rebound surface so that said game ball rebounds in a rebound direction away from said rebound surface, with said pointed end leading said game ball during flight of said game ball away from said rebound surface and said truncated contact surface of said game ball following said pointed end during flight of said game ball away from said rebound surface.

5. A method as defined in claim 4 additionally comprising the step of imparting a spin to said game ball about said central axis during release of said game ball.

6. A method as defined in claim 4 additionally comprising the step of (e) catching said game ball at a catching location during flight of said game ball away from said rebound surface, said catching location being spaced from said rebound surface.

7. A method as defined in claim 6 wherein said steps (a), (b), (c) and (e) are performed by the same person.

8. A method as defined in claim 6 wherein said steps (a), (b), (c) are performed by a first person and wherein said step (e) is performed by a second person.

9. A game ball, comprising:

a first end having a truncated contact surface;

a second end comprising a pointed end; and a body portion disposed between first end and said second end, said body portion being rotationally symmetric about an axis passing through a central portion of said truncated contact surface and said second end, said body portion being resilient so that when said game ball is thrown towards a rebound surface with said second end trailing said first end and when said game ball rebounds from said rebound surface, said pointed end of said game ball will lead said truncated contact surface when said game ball travels away from said rebound surface, wherein said game ball is composed of a substantially solid material without a central air pocket disposed therein.

10. A game ball as defined in claim 9 wherein said game ball is composed solely of a substantially solid molded material without a central air pocket disposed therein.

11. A game ball as defined in claim 9 wherein said body portion comprises an outer cover, an air-tight sealing layer disposed within said outer cover, and a central air pocket disposed within said air-tight sealing layer.

12. A game ball as defined in claim 9 wherein said truncated contact surface comprises a substantially planar surface.

13. A game ball as defined in claim 9 wherein said truncated contact surface comprises a curved surface.

14. A game ball as defined in claim 9 wherein said truncated contact surface has no central aperture formed therein.

15. A game ball as defined in claim 9 wherein said body portion has a first body portion and a second body portion in the form of a transition portion, wherein said game ball has a length, and wherein said transition portion has a length that is 1% to 30% of said length of said game ball.

16. A game ball as defined in claim 15 wherein said transition portion comprises a multiple-sided trapezoidal contour.

17. A game ball, comprising:

a first end having a truncated contact surface;

a second end comprising a pointed end; and a body portion disposed between said first end and said second end, said body portion being rotationally symmetric about an axis passing through a central portion of said truncated contact surface and said second end, said body portion having a resilient construction and a weight distribution that allow said game ball to rebound from a rebound surface in a rebound direction with said pointed end of said game ball leading said truncated contact surface when said game ball travels away from said rebound surface, after said game ball is thrown towards said rebound surface in a throwing direction with said second end trailing said first end, said throwing direction being opposite said rebound direction, said weight distribution not causing said game ball to turn around after said game ball impacts said rebound surface, so that said truncated contact surface does not lead said pointed end during travel of said game ball in said rebound direction, said resilient construction and said weight distribution of said game ball being designed to allow said game ball to be used in a simulated football throwing-and-catching exercise in which said game ball is thrown against said rebound surface from a throwing location spaced from said rebound surface and in which said game ball rebounds from said rebound surface to travel to a catching location spaced from said rebound surface.

18. A game ball as defined in claim 17 wherein said construction and weight distribution of said game ball allows said game ball, when thrown towards said rebound surface with a first rotational spin, to rebound from said rebound surface with a second rotational spin opposite said first rotational spin.

* * * * *